US010996607B2

(12) United States Patent
Rohman

(10) Patent No.: US 10,996,607 B2
(45) Date of Patent: May 4, 2021

(54) PRINTED MEDIA STACK ALIGNMENT

(71) Applicant: Hewlett-Packard Development Company, L.P., Spring, TX (US)

(72) Inventor: Stephen Thomas Rohman, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 311 days.

(21) Appl. No.: 16/331,578

(22) PCT Filed: Sep. 9, 2016

(86) PCT No.: PCT/US2016/051055

§ 371 (c)(1),
(2) Date: Mar. 8, 2019

(87) PCT Pub. No.: WO2018/048425

PCT Pub. Date: Mar. 15, 2018

(65) Prior Publication Data

US 2019/0219959 A1 Jul. 18, 2019

(51) Int. Cl.

| | |
|---|---|
| ***G03G 15/00*** | (2006.01) |
| ***B41J 13/10*** | (2006.01) |
| ***B65H 29/16*** | (2006.01) |
| ***B65H 31/02*** | (2006.01) |
| ***B65H 31/30*** | (2006.01) |

(Continued)

(52) U.S. Cl.

CPC ..... *G03G 15/6541* (2013.01); *B41J 13/106* (2013.01); *B65H 29/16* (2013.01); *B65H 31/02* (2013.01); *B65H 31/3081* (2013.01); *B65H 31/36* (2013.01); *B65H 31/38* (2013.01); *B65H 43/00* (2013.01); *G03G 15/6538* (2013.01); *G03G 15/6547* (2013.01); *B65H 2301/4212* (2013.01); *B65H 2301/4213* (2013.01); *B65H 2403/942* (2013.01); *B65H 2404/1114* (2013.01); *B65H 2405/11151* (2013.01); *B65H 2801/27* (2013.01)

(58) Field of Classification Search

CPC ..... G03G 15/6541
USPC ..... 399/403
See application file for complete search history.

(56) References Cited

U.S. PATENT DOCUMENTS

| | | | |
|---|---|---|---|
| 870,150 | A | 11/1907 | Woodbridge |
| 5,013,021 | A | 5/1991 | Johdai et al. |

(Continued)

FOREIGN PATENT DOCUMENTS

| | | | |
|---|---|---|---|
| JP | 2011255969 | A | 12/2011 |
| KR | 101404733 | B1 | 6/2014 |

*Primary Examiner* — Anthony H Nguyen
(74) *Attorney, Agent, or Firm* — Mannava & Kang

(57) ABSTRACT

According to an example, printed media stack alignment may include actuating a belt and a paddle to shift first and second sheets to a stopper position represented by register of the first and second sheets against a stopper. The stopper may be actuated to shift the first and second sheets to an eject position, where the eject position is intermediate to a sheet deposit position and the stopper position. The belt and the paddle may be actuated to shift the first sheet, the second sheet, and a third sheet received at the sheet deposit position to the stopper position. The stopper may be actuated to shift the first, second, and third sheets to the eject position. Further, an ejector may be actuated to eject a stack including the first, second, and third sheets from the eject position.

15 Claims, 14 Drawing Sheets

(51) Int. Cl.

| | |
|---|---|
| ***B65H 31/36*** | (2006.01) |
| ***B65H 43/00*** | (2006.01) |
| ***B65H 31/38*** | (2006.01) |

(56) References Cited

U.S. PATENT DOCUMENTS

| | | | | |
|---|---|---|---|---|
| 6,412,774 | B1 * | 7/2002 | Saito | B42C 1/12 271/220 |
| 8,657,283 | B2 | 2/2014 | Iwata et al. | |
| 2008/0075510 | A1 * | 3/2008 | Kubo | B65H 9/101 399/407 |
| 2009/0166946 | A1 | 7/2009 | Iguchi et al. | |
| 2009/0283954 | A1 | 11/2009 | Kanda | |
| 2012/0025456 | A1 | 2/2012 | Iljima et al. | |
| 2013/0016147 | A1 | 1/2013 | Cardells Tormo | |
| 2014/0291922 | A1 | 10/2014 | Yamamoto | |
| 2014/0346726 | A1 | 11/2014 | Matsuo et al. | |
| 2014/0363265 | A1 | 12/2014 | Takemasa | |
| 2015/0091246 | A1 | 4/2015 | Yoshida et al. | |
| 2015/0183610 | A1 | 7/2015 | Matsuki et al. | |
| 2016/0194172 | A1 * | 7/2016 | Kimura | B65H 31/3045 271/306 |
| 2017/0137253 | A1 * | 5/2017 | Sato | B65H 9/106 |
| 2018/0348692 | A1 * | 12/2018 | Yoshida | B42C 1/12 |

* cited by examiner

PRINTED MEDIA STACK ALIGNMENT

BACKGROUND

A printer may be described as a peripheral which is used to make a persistent human readable representation of graphics or text on physical media such as paper. Examples of printer mechanisms include black and white, and/or color laser printers used for documents, and black and white, and/or color inkjet printers which may be used to produce high quality photograph output.

BRIEF DESCRIPTION OF DRAWINGS

Features of the present disclosure are illustrated by way of example and not limited in the following figure(s), in which like numerals indicate like elements, in which.

DETAILED DESCRIPTION

Figure 1:
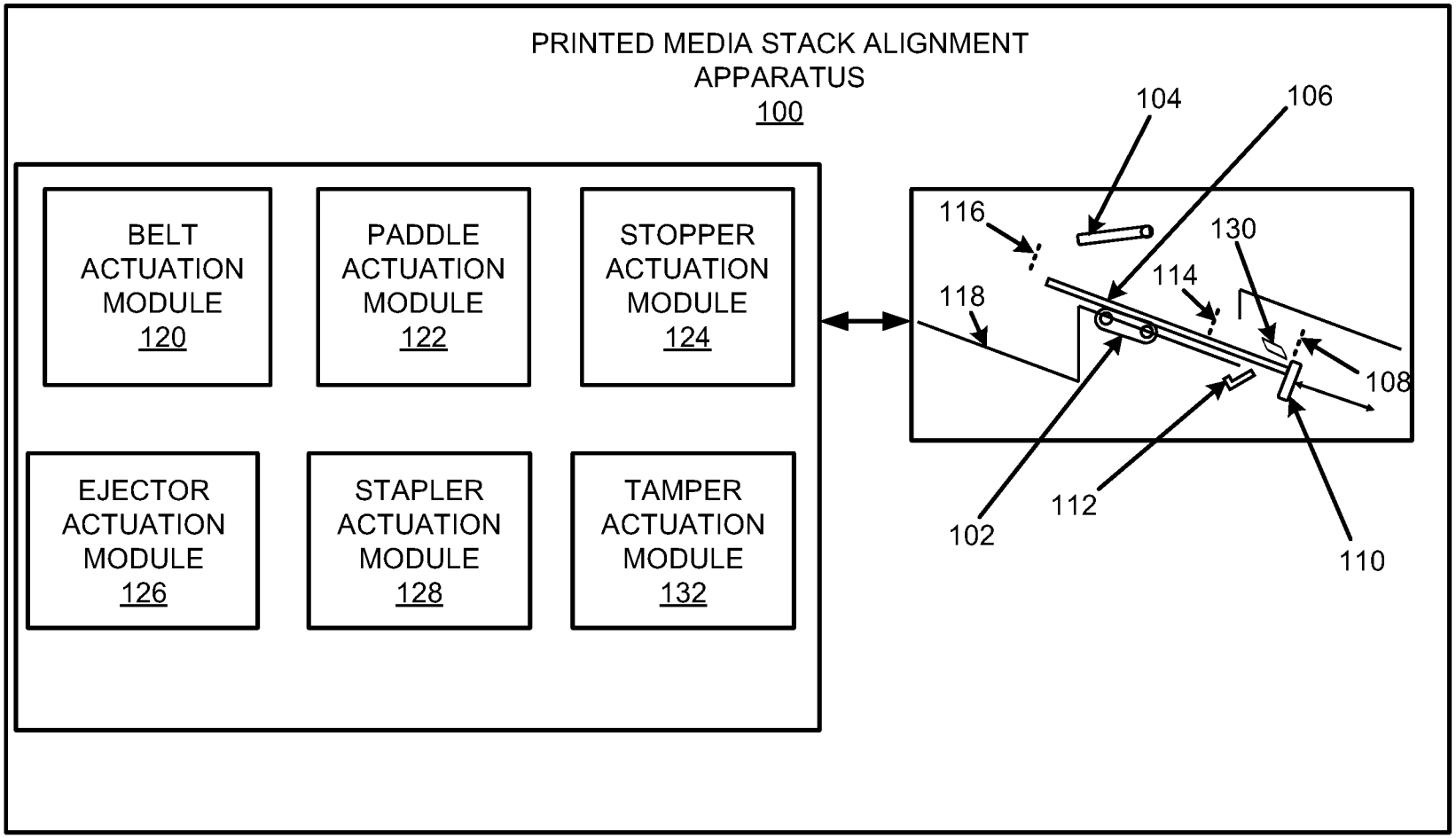
FIG. 1 illustrates a layout of a printed media stack alignment apparatus, according to an example of the present disclosure.

For simplicity and illustrative purposes, the present disclosure is described by referring mainly to examples. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure.

Throughout the present disclosure, the terms "a" and "an" are intended to denote at least one of a particular element. As used herein, the term "includes" means includes but not limited to, the term "including" means including but not limited to. The term "based on" means based at least in part on.

A printed media stack alignment apparatus and a method for printed media stack alignment provide for alignment of sheets of printed media in a stack formed by such sheets. That is, the apparatus and method disclosed herein provide for edges of sheets of printed media in a stack to be aligned within a specified tolerance. For example, the specified tolerance may include 2 mm or less of misalignment between common edges of any given sheet in a stack. For the example of a letter size sheet (i.e., 8.5×11.0 inches (215.9×279.4 mm)), the misalignment may be measured relative to a plane that includes the shorter edge (i.e., 8.5 inches (215.9 mm)) for any given sheet in a stack, where the plane is generally orthogonal to the surface of the sheets in the stack.

In printer systems, the misalignment can result from high sheet-to-sheet friction of the sheets of a stack when an upper sheet and a lower sheet are shifted to a stopper. The high sheet-to-sheet friction of the sheets of the stack may be further increased for inkjet printer systems in which the wetness of ink can result in an increase of the sheet-to-sheet friction. For example, once a first sheet (e.g., the lower sheet) is deposited in a deposit tray, the first sheet is shifted to the stopper. For a second sheet (e.g., the upper sheet) deposited onto the first sheet, the high sheet-to-sheet friction can result in misalignment when the second sheet is shifted to the stopper. Similarly, for further sheets deposited onto the second sheet, the high sheet-to-sheet friction can result in misalignment when the further sheets are shifted to the stopper. This misalignment can be particularly noticeable if the stack is stapled, or otherwise bound.

The apparatus and method disclosed herein overcome these technical challenges in printer systems by minimizing such misalignment to within a specified tolerance (e.g., 2 mm or less). According to an example, for the apparatus and method disclosed herein, the first and second sheets received at a sheet deposit position are shifted to a stopper position represented by register of sheets against a stopper. The first and second sheets are then shifted to an eject position that is intermediate to the sheet deposit position and the stopper position. For each further sheet deposited at the sheet deposit position, the entire stack is shift to the stopper position, and then shifted back to the eject position. Once the stack is complete, the stack is ejected from the eject position to an output bin. Alternatively, once the stack is complete, the stack may be stapled (or otherwise bound) and then ejected from the eject position to the output bin. In this manner, misalignment of the sheets in the stack is minimized to within the specified tolerance.

For the apparatus and method disclosed herein, a sheet of printed media may be described as paper (or any other type of media) that includes text, graphics, or any type of printed information from a memory of the printed media stack alignment apparatus, from a memory of a personal computer or other such device connected to the printed media stack alignment apparatus, or from any other source (e.g., wireless device, etc.).

Figure 2:
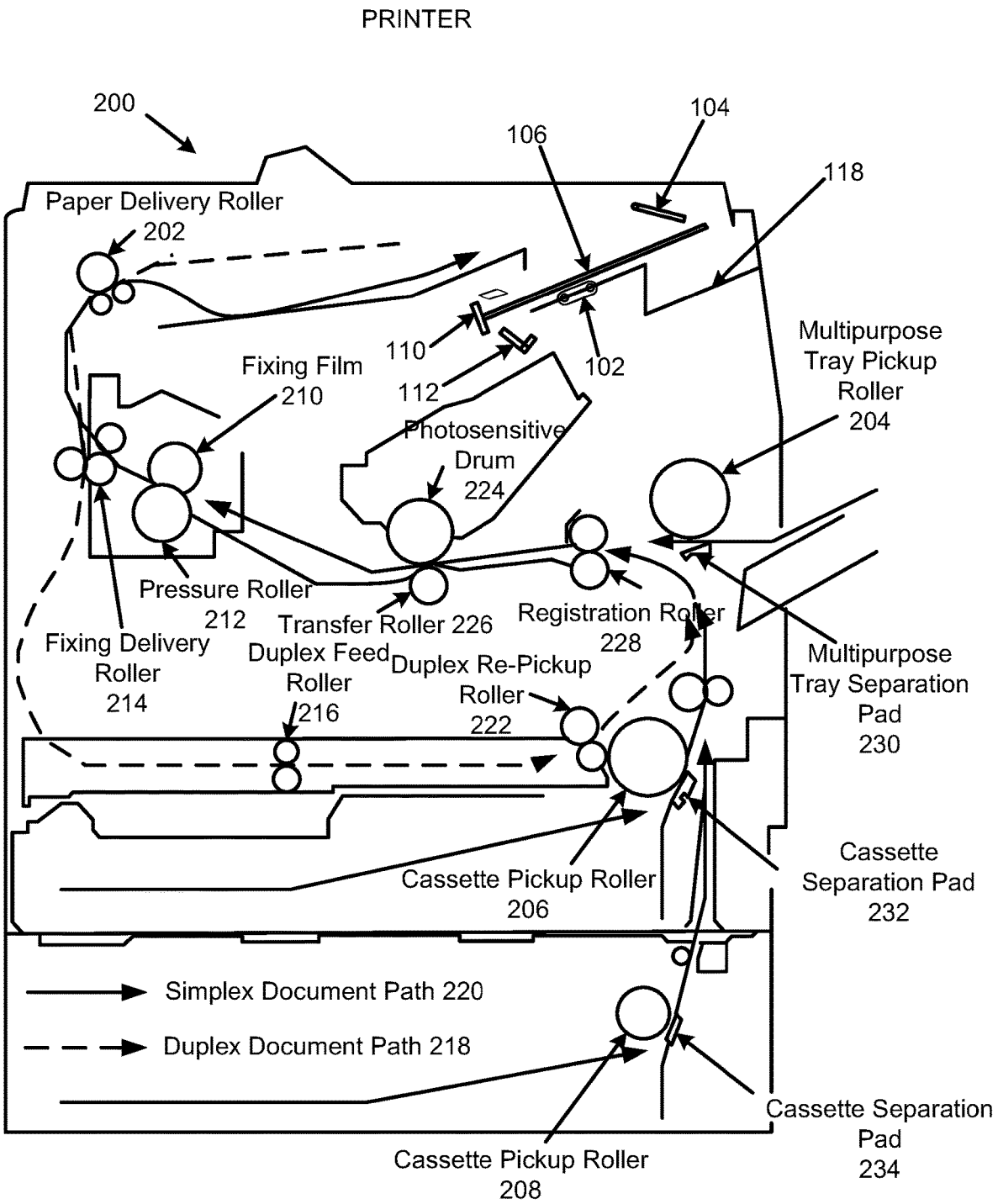
FIG. 2 illustrates an environment of the printed media stack alignment apparatus of FIG. 1, according to an example of the present disclosure.

FIG. 1 illustrates a layout of a printed media stack alignment apparatus (hereinafter also referred to as "apparatus 100"), according to an example of the present disclosure. According to examples, the apparatus 100 may include or be provided as a component of a laser printer, an inkjet printer, or any type of printer. For example, FIG. 2 illustrates an environment 200 of the apparatus 100, according to an example of the present disclosure. For the example of FIG. 2, the environment 200 may represent a printer which includes the apparatus 100 as a component thereof. Alternatively, various components (e.g., a paddle actuation module, a belt actuation module, a paddle actuation module, an ejector actuation module, etc.) of the apparatus 100 may be disposed separately from the printer (illustrated in FIG. 2) to control operations of the printer.

Referring to FIGS. 1 and 2, the apparatus 100 may include a belt 102 and a paddle 104 to shift sheets 106 (single sheet shown in FIG. 1) of printed media to a stopper position 108 represented by register of the sheets 106 against a stopper 110.

An ejector 112 may be actuated to eject the sheets 106 of printed media from an eject position 114 that is intermediate to a sheet deposit position 116 and the stopper position 108.

The ejector 112 may be actuated to eject the sheets 106 of printed media to an output bin 118.

A belt actuation module 120 and a paddle actuation module 122 may respectively actuate the belt 102 and the paddle 104 to shift first and second sheets received at the sheet deposit position 116 to the stopper position 108.

A stopper actuation module 124 may actuate the stopper 110 to shift the first and second sheets to the eject position 114.

An ejector actuation module 126 may actuate the ejector 112 to eject a stack including the first, the second, and any further sheets from the eject position 114.

A stapler actuation module 128 may actuate a stapler 130 to staple the stack including the first, second, and any further sheets prior to ejection from the eject position 114.

A tamper actuation module 132 may actuate a tamper 134 (see FIG. 3I) on a side (or two tampers on opposite sides) of the sheets 106 to align the sides of a stack including the sheets 106. When a stack including the sheets 106 is shifted to the stopper position 108, the tamper 134 on one side (or both tampers 134) may tap the edges of the sheets 106 to align the sides of the stack.

Referring to FIG. 2, according to examples, the apparatus 100 is illustrated as being implemented with a laser printer. It is apparent in view of this disclosure that the apparatus 100 may be similarly implemented with an inkjet or another type of printer, with the laser printing components being replaced with components such as ink cartridges, etc. For the example of implementation of the apparatus 100 with a laser printer, a sheet of printed media may traverse a paper path between a paper delivery roller 202 and a paper pickup roller (e.g., multipurpose tray pickup roller 204, cassette pickup roller 206, cassette pickup roller 208 as illustrated in FIG. 2, or another such pickup roller).

For the example of implementation of the apparatus 100 with a laser printer, fixing film 210 may be used to heat and fix toner on the sheets 106. Alternatively, for implementation of the apparatus 100 with an inkjet or another type of printer, ink cartridges may be used to print onto the sheets 106. For the example of implementation of the apparatus 100 with a laser printer, a pressure roller 212 may be configured to apply pressure on the fixing film 210 to fix the toner on the sheets 106. For the example of implementation of the apparatus 100 with a laser printer, a fixing delivery roller 214 may be configured to deliver the sheets 106 after the fixing film 210 and the pressure roller 212. A duplex feed roller 216 may be configured to deliver the sheets 106 into a duplex document path 218 (shown as dotted lines in FIG. 2) after the simplex document path 220 (shown as solid lines in FIG. 2) is completed. A duplex re-pickup roller 222 may be configured to pick up the sheets 106 in the duplex document path. For the example of implementation of the apparatus 100 with a laser printer, a photosensitive drum 224 may be configured to create the developed image with negative-charged toner. For the example of implementation of the apparatus 100 with a laser printer, a transfer roller 226 may be configured to apply a positive charge to attract the negative-charged toner. For the example of implementation of the apparatus 100 with a laser printer, a registration roller 228 may be configured to deliver the sheets 106 into an electrophotographic (EP) process. The multipurpose tray pickup roller 204 may be configured to pick up the sheets 106 from a multipurpose tray. A multipurpose tray separation pad 230 for the multipurpose tray may be configured to provide for delivery of a single document of the sheets 106 (and blank papers) at any given time. A cassette separation pad 232 for an upper cassette may be configured to provide for delivery of a single document of the sheets 106 at any given time. The cassette pickup roller 206 for the upper cassette may be configured to pick up a document of the sheets 106 (and blank papers) from the upper cassette. A cassette separation pad 234 for a lower cassette may be configured to provide for delivery of a single document of the sheets 106 at any given time. The cassette pickup roller 208 for the lower cassette may be configured to pick up a document of the sheets 106 (and blank papers) from the lower cassette.

The modules and other elements of the apparatus 100 may be machine readable instructions stored on a non-transitory computer readable medium. In this regard, the apparatus 100 may include or be a non-transitory computer readable medium. In addition, or alternatively, the modules and other elements of the apparatus 100 may be hardware or a combination of machine readable instructions and hardware.

FIGS. 3A-3H illustrate steps for printed media stack alignment for the apparatus 100, according to an example of the present disclosure. Further, FIG. 3I illustrates an isometric view of certain components of the apparatus 100 for further illustrating the steps of FIGS. 3A-3H, according to an example of the present disclosure.

Figure 3A:
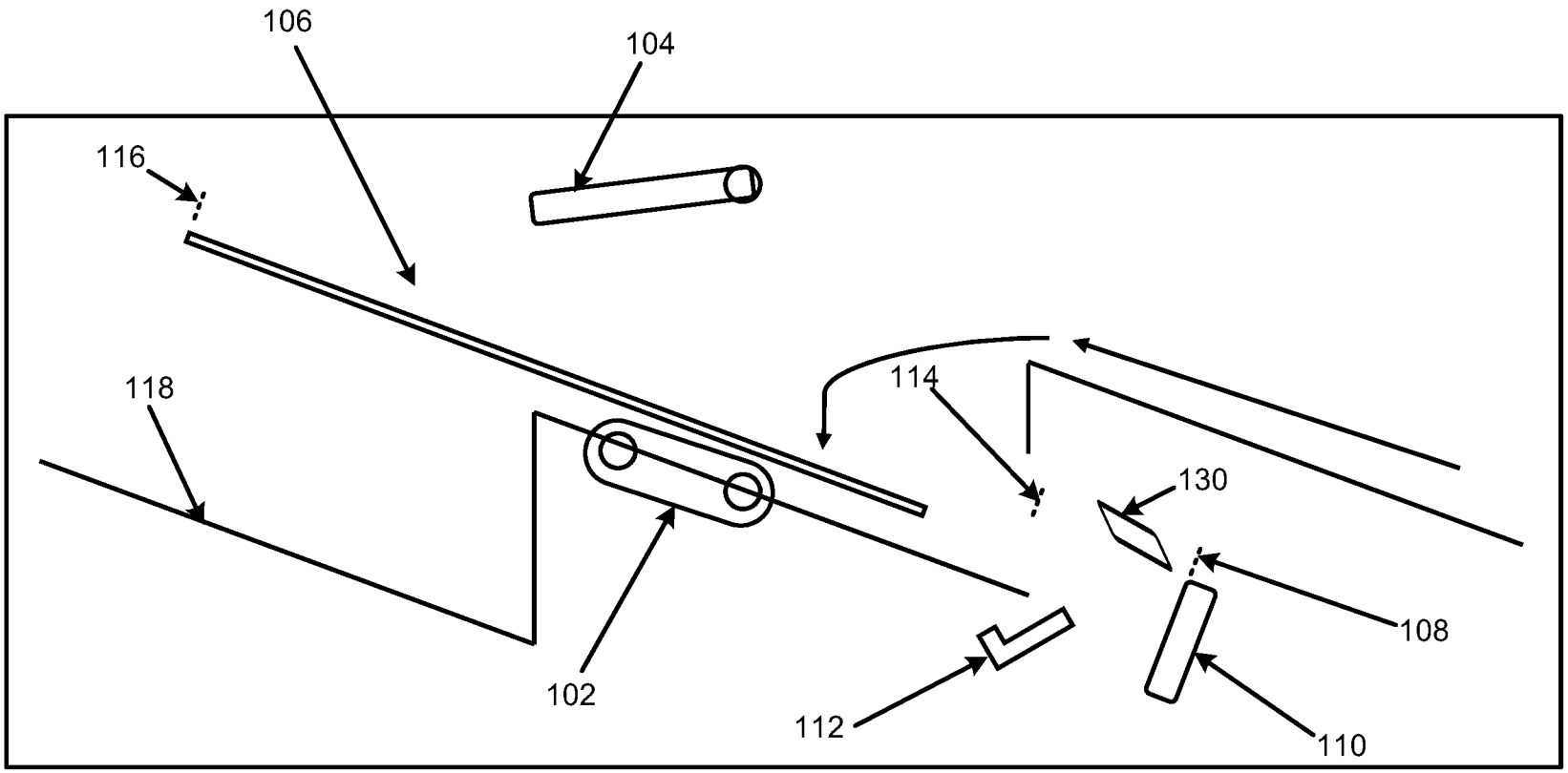
FIGS. 3A-3H illustrate steps for printed media stack alignment for the printed media stack alignment apparatus of FIG. 1.
Figure 3B:
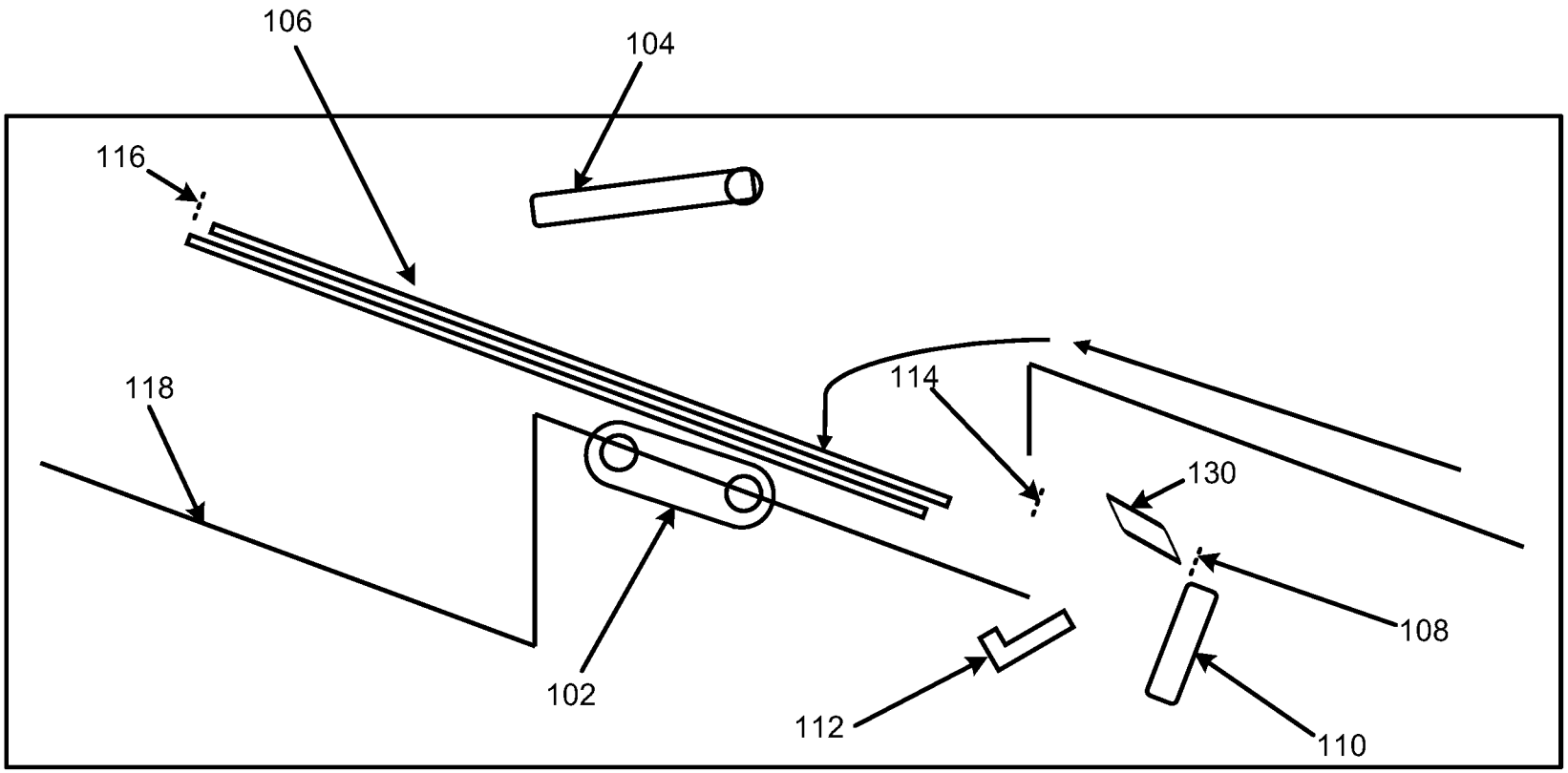

Referring to FIGS. 1, 2, 3A, and 3B, the belt actuation module 120 and the paddle actuation module 122 may determine that first and second sheets (of the sheets 106) are received at the sheet deposit position 116. For example, FIG. 3A illustrates a first sheet being received at the sheet deposit position 116 onto the belt 102. Further, FIG. 3B illustrates a second sheet being received at the sheet deposit position 116 onto the first sheet illustrated in FIG. 3A. According to an example, the determination of receiving the first and second sheets at the sheet deposit position 116 may be based on an analysis of operation of the paper delivery roller 202, and related components of a printer, such as, the printer of FIG. 2.

Figure 3C:
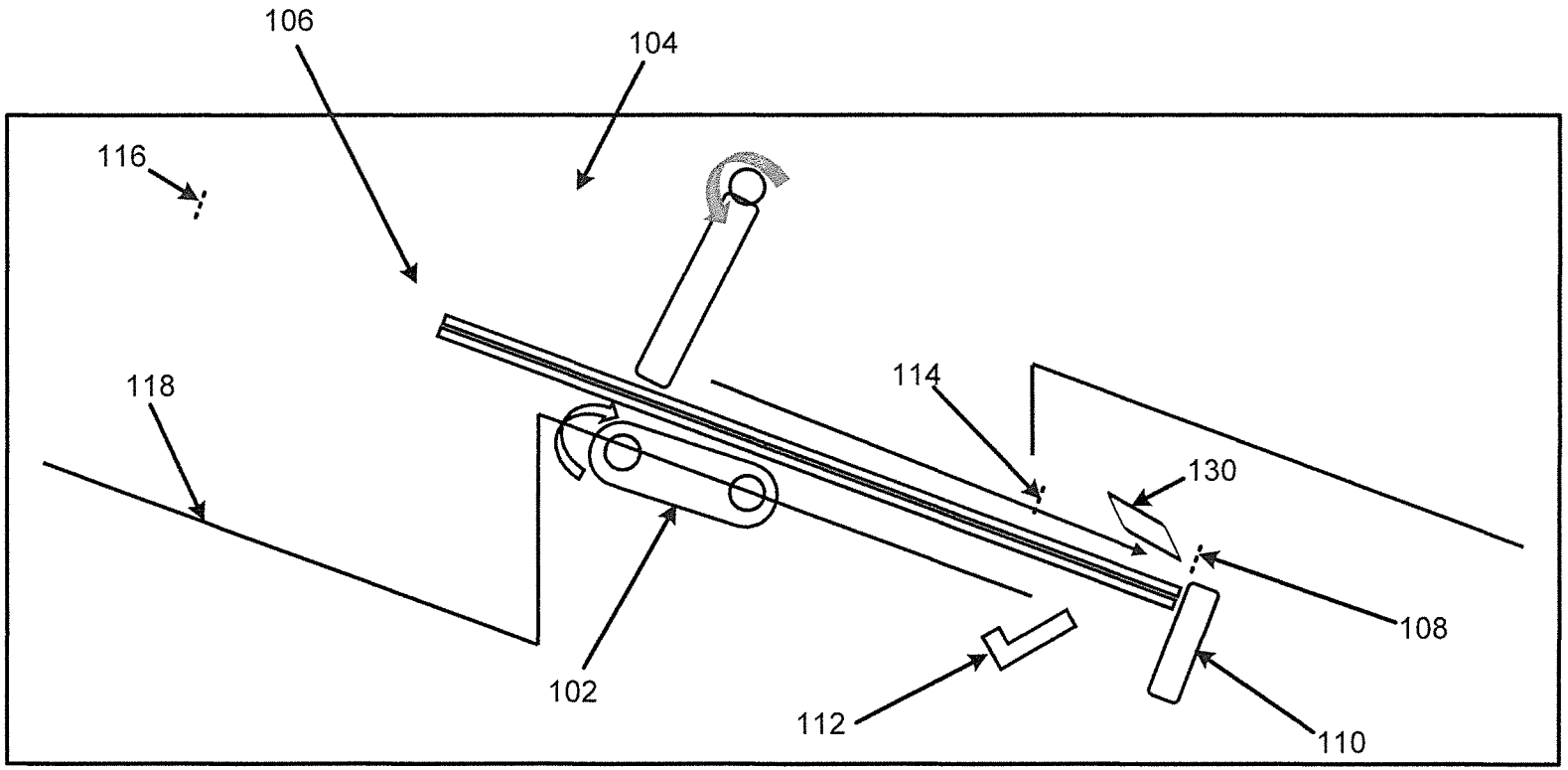

Referring to FIGS. 1, 2, and 3C, the belt actuation module 120 and the paddle actuation module 122 may respectively actuate the belt 102 and the paddle 104 to shift the first and second sheets received at the sheet deposit position 116 to the stopper position 108.

With respect to actuation of the belt 102 and the paddle 104 to shift the first and second sheets received at the sheet deposit position 116 to the stopper position 108, the belt actuation module 120 may determine that the first sheet is received at the sheet deposit position 116, and maintain the first sheet at the sheet deposit position 116. Further, the paddle actuation module 122 may determine that the second sheet is received at the sheet deposit position 116. Based on the determination that the first and second sheets are received at the sheet deposit position 116, the belt actuation module 120 and the paddle actuation module 122 may respectively actuate the belt 102 and the paddle 104 to shift the first and second sheets received at the sheet deposit position 116 to the stopper position 108. According to an example, the paddle 104 may be rotated once or a plurality of times to shift the associated sheet to align a stack of the sheets.

With respect to actuation of the belt 102 and the paddle 104 to shift the first and second sheets received at the sheet deposit position 116 to the stopper position 108, the belt actuation module 120 may rotate the belt 102 in a first direction (e.g., clockwise direction in the orientation of FIG. 3C) to shift the first sheet that is deposited onto the belt 102 to the stopper position 108. Further, the paddle actuation module 122 may rotate the paddle 104 in a second direction (e.g., counter-clockwise direction in the orientation of FIG.

3C) that is generally opposite to the first direction to shift the second sheet that is deposited onto the first sheet to the stopper position 108.

According to an example, the rotation of the belt 102 is synchronized with the rotation of the paddle 104 to simultaneously shift the first and second sheets to the stopper position 108. That is, both the first and second sheets may be simultaneously shifted together towards the stopper position 108.

According to another example, the rotation of the belt 102 is synchronized with the rotation of the paddle 104 to shift the second sheet to the stopper position 108 prior to shifting of the first sheet to the stopper position 108. That is, the second sheet is shifted a predetermined amount towards the stopper position 108 prior to shifting of the first sheet towards the stopper position 108. This type of shifting of the first and second sheets towards the stopper position 108 may be employed, for example, when there is a greater amount of measured friction between the first and second sheets.

Figure 3D:
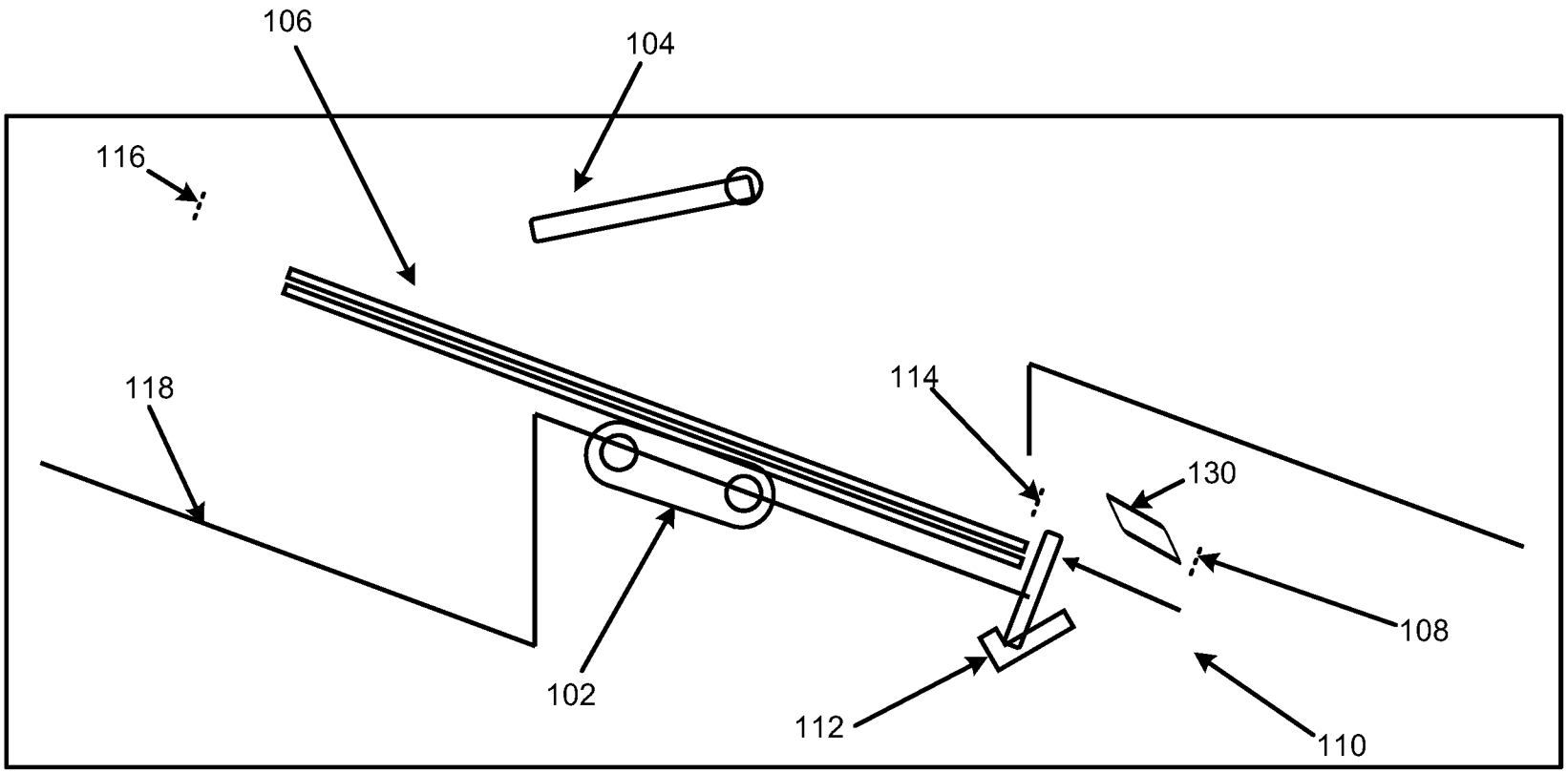

Referring to FIGS. 1, 2, and 3D, the stopper actuation module 124 may actuate the stopper 110 to shift the first and second sheets to the eject position 114.

Figure 3E:
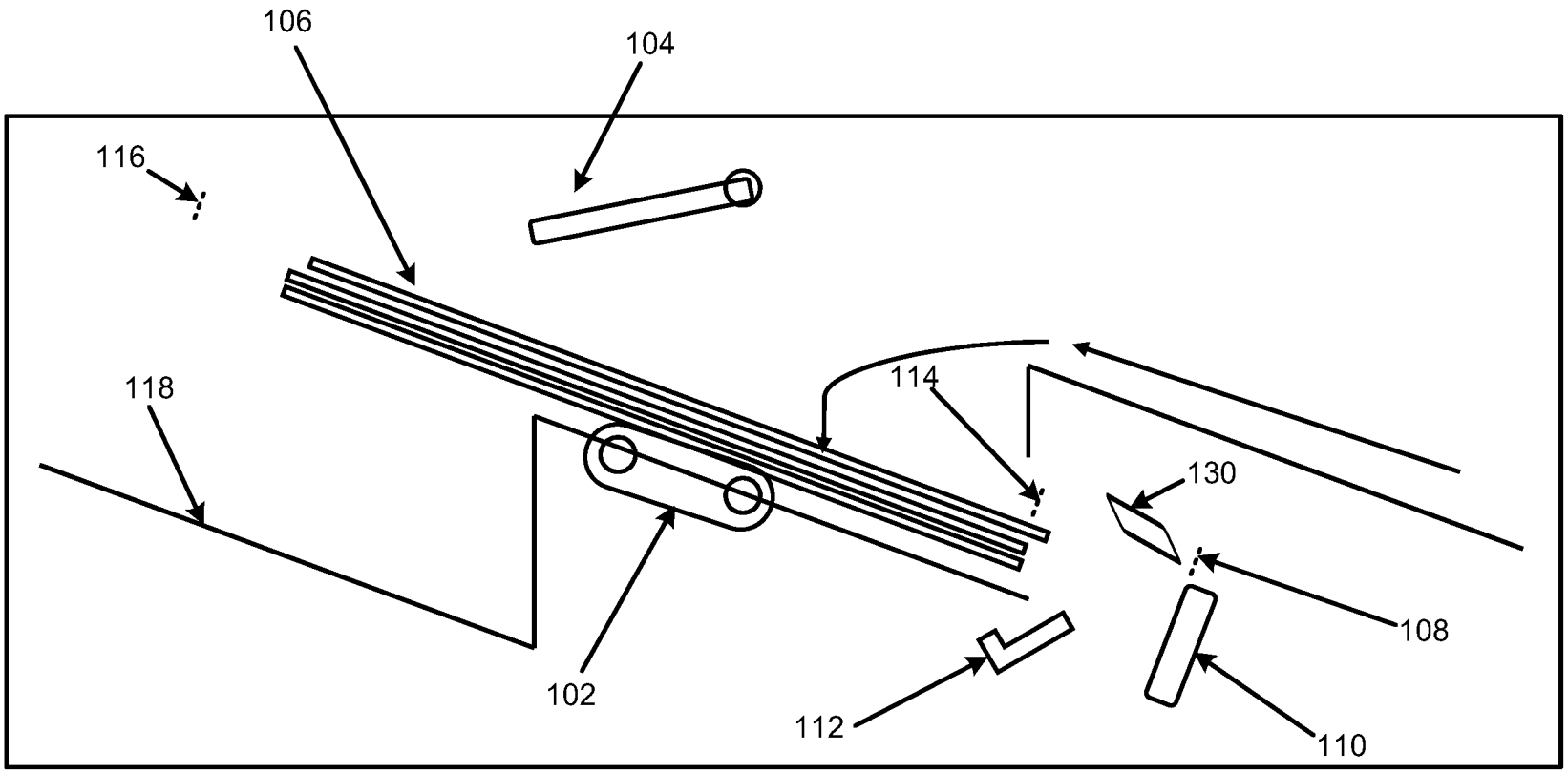

Referring to FIGS. 1, 2, and 3E, the belt actuation module 120 and the paddle actuation module 122 may determine that a third sheet is received at the sheet deposit position 116.

Figure 3F:
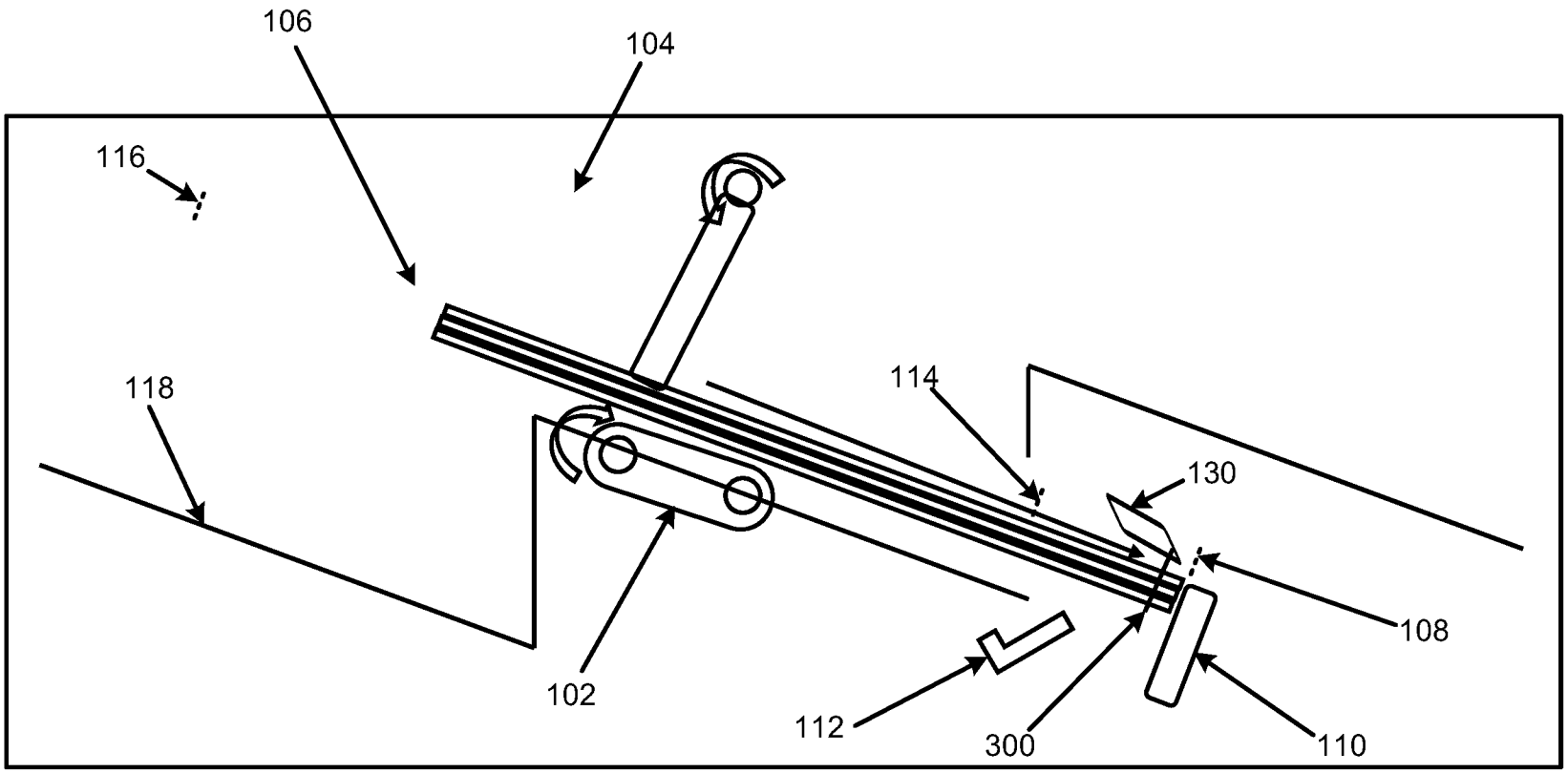

Referring to FIGS. 1, 2, and 3F, the belt actuation module 120 and the paddle actuation module 122 may respectively actuate the belt 102 and the paddle 104 to shift the first, the second, and the third sheet received at the sheet deposit position 116 to the stopper position 108. If there are no further sheets to be printed, the stapler actuation module 128 may actuate the stapler 130 to staple at 300 the stack including the first, second, and third sheets prior to ejection from the eject position 114.

Figure 3G:
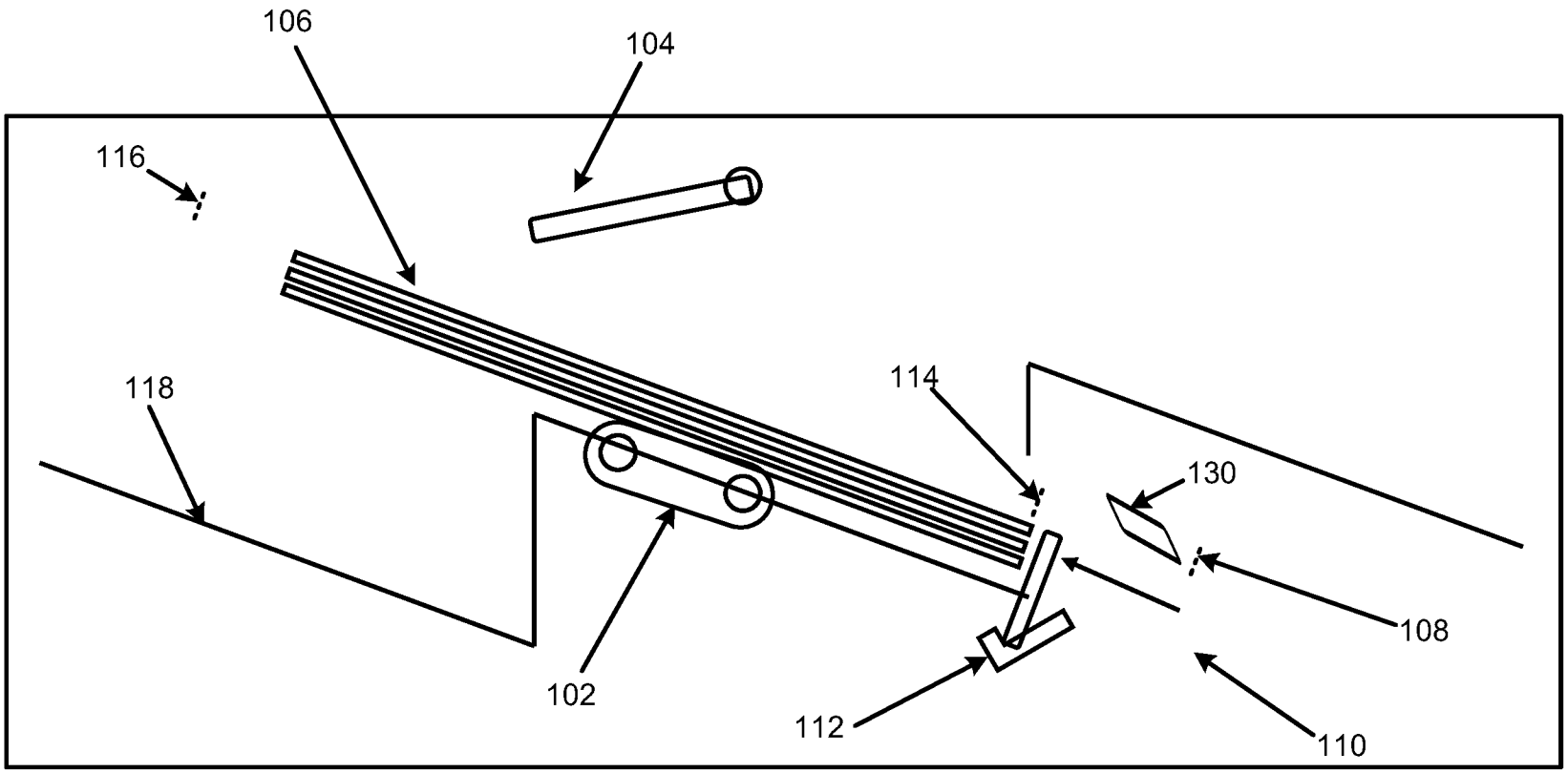

Referring to FIGS. 1, 2, and 3G, the stopper actuation module 124 may actuate the stopper 110 to shift the first, second, and third sheets to the eject position 114.

Figure 3H:
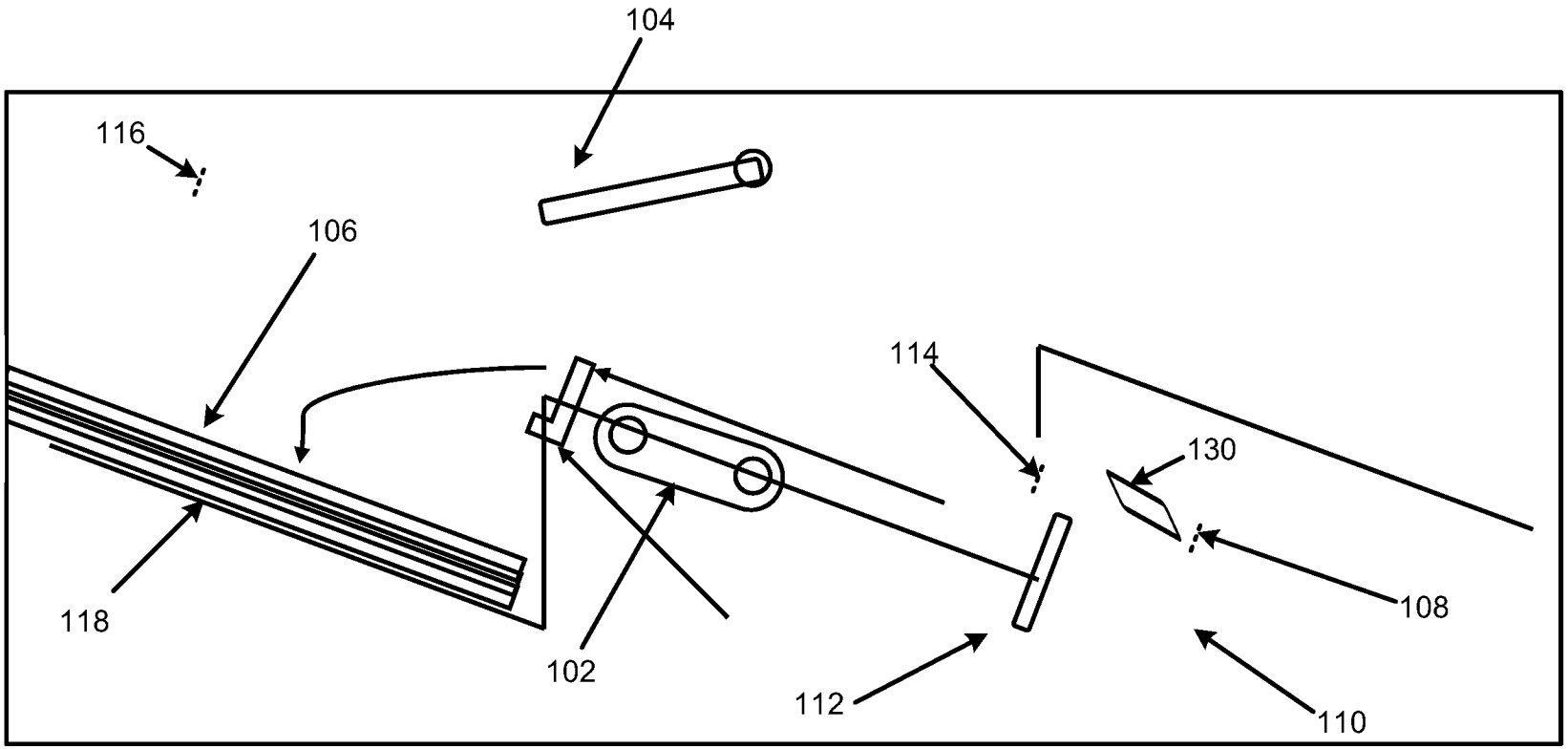
Figure 3I:
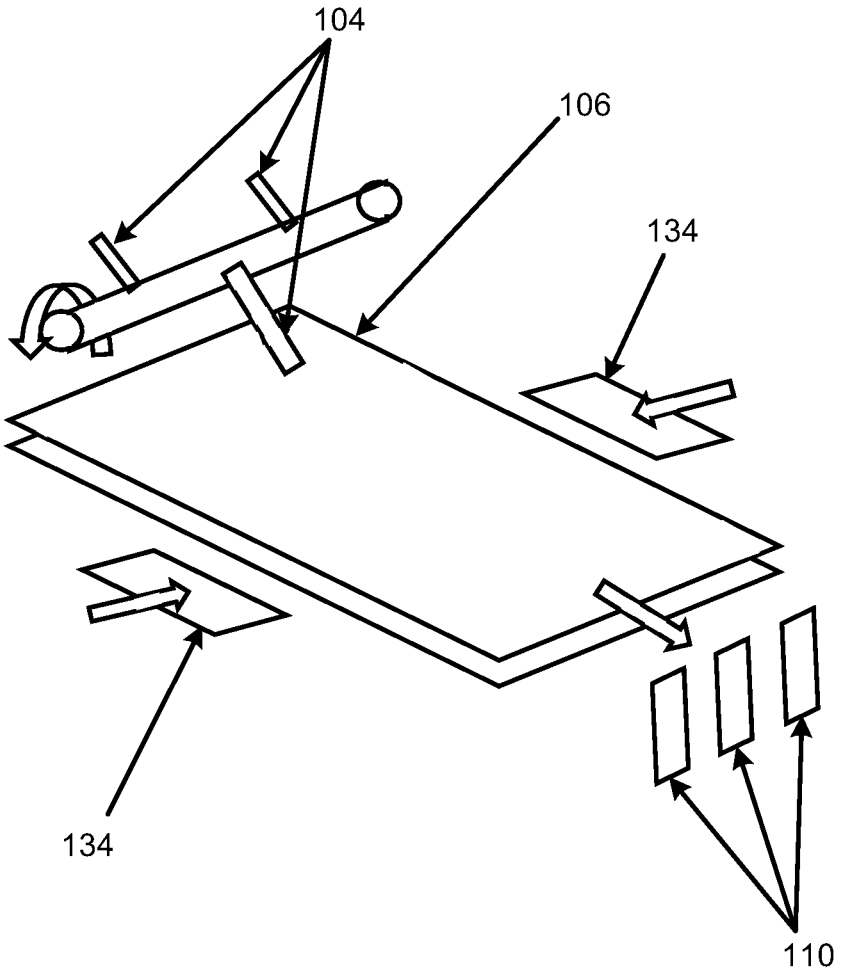
FIG. 3I illustrates an isometric view of certain components of the printed media stack alignment apparatus of FIG. 1 for further illustrating the steps of FIGS. 3A-3H, according to an example of the present disclosure.

Referring to FIGS. 1, 2, and 3H, if there are no further sheets to be printed, the ejector actuation module 126 may actuate the ejector 112 to eject a stack including the first, second, and third sheets from the eject position 114. If there are further sheets to be printed, referring to FIGS. 1, 2, and 3E-3H, alternating actuation of the belt 102 and the paddle 104 may be continued to shift the first sheet, the second sheet, the third sheet, and any further sheets received at the sheet deposit position 116 to the stopper position 108, and the stopper 110 to shift the first sheet, the second sheet, the third sheet, and any further sheets to the eject position 114.

Referring to FIGS. 1, 2, and 3A-3I, and particularly FIG. 3I, the tamper actuation module 132 may actuate the tamper 134 on a side (or two tampers on opposite sides) of the sheets 106 to align the sides of a stack including the sheets 106. When a stack including the sheets 106 is shifted to the stopper position 108, the tamper 134 on one side (or both tampers 134) may tap the edges of the sheets 106 to align the sides of the stack.

According to an example, the paddle 104 may include three parts as shown in FIG. 3I, a central sub-paddle and two outer sub-paddles. The central sub-paddle may be longer than the two outer sub-paddles as illustrated in FIG. 3I. Further, the central sub-paddle may be 180° (or another angle) out of phase compared to the two outer sub-paddles. In this manner, the longer central sub-paddle may target an edge of a sheet (as well as other sheets in a stack) to shift the sheet towards the stopper 110, whereas the outer sub-paddles may target an upper surface of the sheet to shift the sheet towards the stopper 110.

According to an example, the stopper 110 may include three parts as shown in FIG. 3I, a central stopper and two outer stoppers. The central stopper may shift the sheets 106 to the eject position 114, whereas the outer stoppers may be configured as static stoppers.

Figure 4:
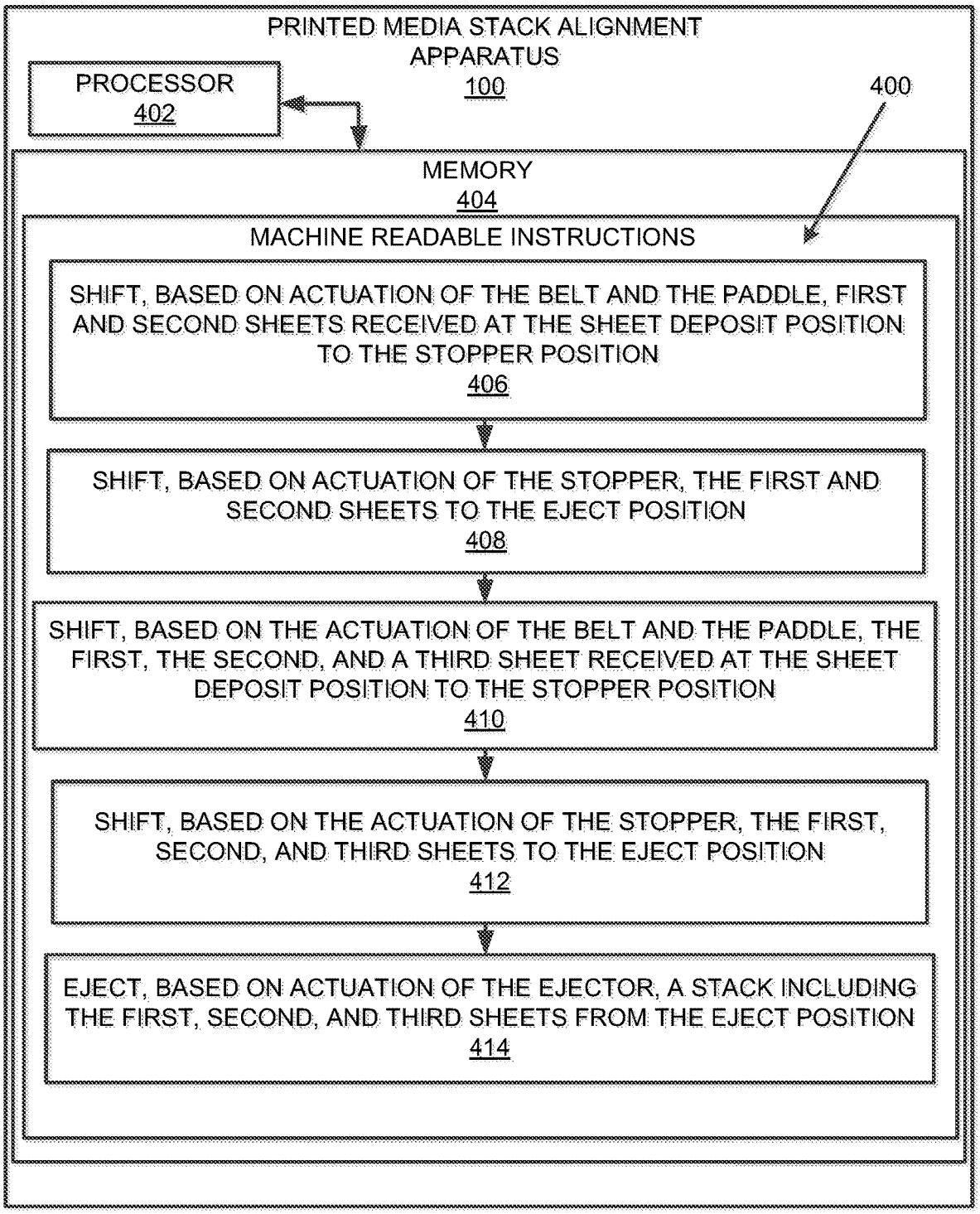
FIG. 4 illustrates a flowchart of a method for printed media stack alignment, according to an example of the present disclosure.
Figure 5:
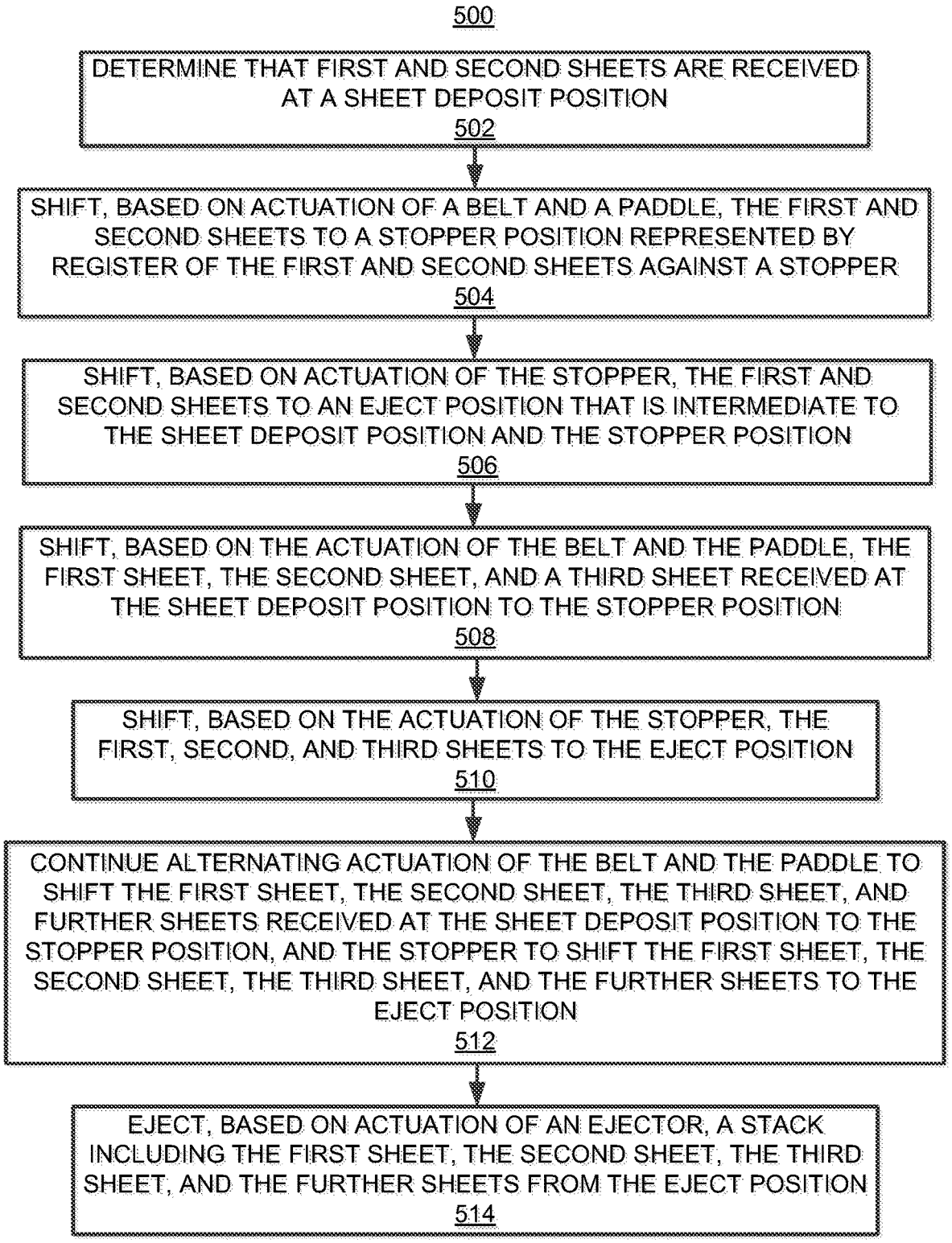
FIG. 5 illustrates a flowchart of another method for printed media stack alignment, according to an example of the present disclosure.
Figure 6:
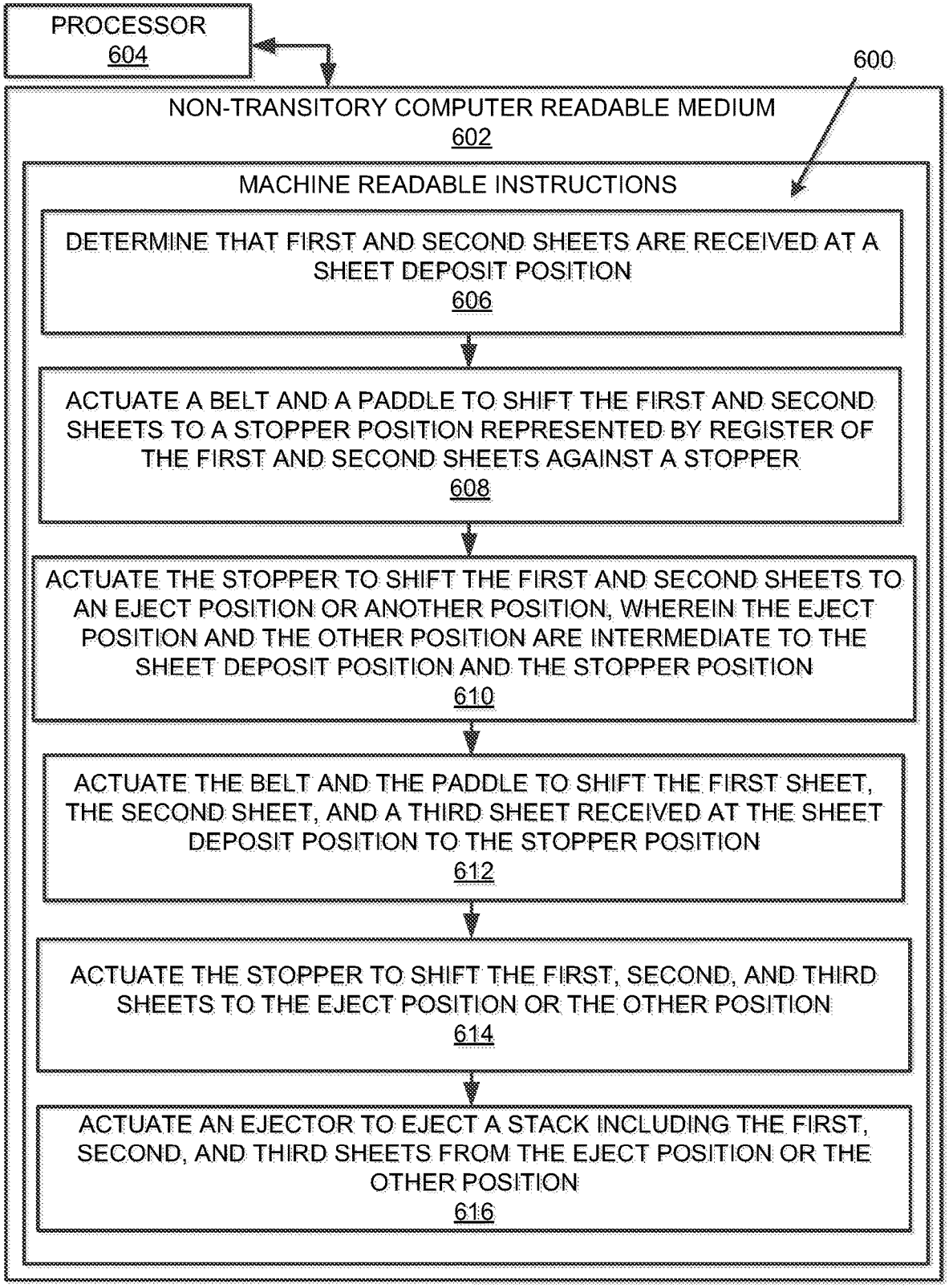
FIG. 6 illustrates a flowchart of a further method for printed media stack alignment, according to an example of the present disclosure.

FIGS. 4-6 respectively illustrate flowcharts of methods 400, 500, and 600 for printed media stack alignment, according to examples. The methods 400, 500, and 600 may be implemented on the apparatus 100 described above with reference to FIGS. 1-3I by way of example and not limitation. The methods 400, 500, and 600 may be practiced in other apparatus. In addition to showing the method 400, FIG. 4 shows hardware of the apparatus 100 that may execute the method 400. The hardware may include a processor 402, and a memory 404 storing machine readable instructions that when executed by the processor cause the processor to perform the steps of the method 400. The memory 404 may represent a non-transitory computer readable medium. FIG. 5 may represent a method for printed media stack alignment, and the steps of the method. FIG. 6 may represent a non-transitory computer readable medium 602 having stored thereon machine readable instructions to provide printed media stack alignment. The machine readable instructions, when executed, cause a processor 604 to perform steps of the method 600 also shown in FIG. 6.

The processor 402 of FIG. 4 and/or the processor 604 of FIG. 6 may include a single or multiple processors or other hardware processing circuit, to execute the methods, functions and other processes described herein. These methods, functions and other processes may be embodied as machine readable instructions stored on a computer readable medium, which may be non-transitory (e.g., the non-transitory computer readable medium 602 of FIG. 6), such as hardware storage devices (e.g., RAM (random access memory), ROM (read only memory), EPROM (erasable, programmable ROM), EEPROM (electrically erasable, programmable ROM), hard drives, and flash memory). The memory 404 may include a RAM, where the machine readable instructions and data for a processor may reside during runtime.

Referring to FIGS. 1-4, and particularly to the method 400 shown in FIG. 4, at block 406, the method 400 may include shifting, based on actuation of the belt 102 and the paddle 104, first and second sheets received at the sheet deposit position 116 to the stopper position 108.

At block 408, the method 400 may include shifting, based on actuation of the stopper 110, the first and second sheets to the eject position 114.

At block 410, the method 400 may include shifting, based on the actuation of the belt 102 and the paddle 104, the first, the second, and a third sheet received at the sheet deposit position 116 to the stopper position 108.

At block 412, the method 400 may include shifting, based on the actuation of the stopper 110, the first, second, and third sheets to the eject position 114.

At block 414, the method 400 may include ejecting, based on actuation of the ejector 112, a stack including the first, second, and third sheets from the eject position 114.

Referring to FIGS. 1-3I and 5, and particularly FIG. 5, for the method 500, at block 502, the method may include determining that first and second sheets are received at the sheet deposit position 116.

At block 504, the method 500 may include shifting, based on actuation of the belt 102 and the paddle 104, the first and second sheets to a stopper position 108 represented by register of the first and second sheets against the stopper 110.

At block 506, the method 500 may include shifting, based on actuation of the stopper 110, the first and second sheets to an eject position 114 that is intermediate to the sheet deposit position 116 and the stopper position 108.

At block 508, the method 500 may include shifting, based on the actuation of the belt 102 and the paddle 104, the first sheet, the second sheet, and a third sheet received at the sheet deposit position 116 to the stopper position 108.

At block 510, the method 500 may include shifting, based on the actuation of the stopper 110, the first, second, and third sheets to the eject position 114.

At block 512, the method 500 may include continuing alternating actuation of the belt 102 and the paddle 104 to shift the first sheet, the second sheet, the third sheet, and further sheets received at the sheet deposit position 116 to the stopper position 108, and the stopper 110 to shift the first sheet, the second sheet, the third sheet, and the further sheets to the eject position 114.

At block 514, the method 500 may include ejecting, based on actuation of an ejector 112, a stack including the first sheet, the second sheet, the third sheet, and the further sheets from the eject position 114.

Referring to FIGS. 1-3I and 6, and particularly FIG. 6, for the method 600, at block 606, the method may include determining that first and second sheets are received at the sheet deposit position 116.

At block 608, the method 600 may include actuating the belt 102 and the paddle 104 to shift the first and second sheets to the stopper position 108 represented by register of the first and second sheets against the stopper 110.

At block 610, the method 600 may include actuating the stopper 110 to shift the first and second sheets to the eject position 114 or another position, wherein the eject position 114 and the other position are intermediate to the sheet deposit position 116 and the stopper position 108. For example, the other position may be a position between the sheet deposit position 116 and the eject position 114. Alternatively, the other position may be a position between the eject position 114 and the stopper position 108.

At block 612, the method 600 may include actuating the belt 102 and the paddle 104 to shift the first sheet, the second sheet, and a third sheet received at the sheet deposit position 116 to the stopper position 108.

At block 614, the method 600 may include actuating the stopper 110 to shift the first, second, and third sheets to the eject position 114 or the other position.

At block 616, the method 600 may include actuating an ejector 112 to eject a stack including the first, second, and third sheets from the eject position 114 or the other position.

What has been described and illustrated herein is an example along with some of its variations. The terms, descriptions and figures used herein are set forth by way of illustration only and are not meant as limitations. Many variations are possible within the spirit and scope of the subject matter, which is intended to be defined by the following claims—and their equivalents—in which all terms are meant in their broadest reasonable sense unless otherwise indicated.

What is claimed is:

1. A printed media stack alignment apparatus comprising:

a belt and a paddle to shift sheets of printed media to a stopper position represented by register of the sheets against a stopper;

an ejector to eject the sheets from an eject position that is intermediate to a sheet deposit position and the stopper position;

a processor; and a memory storing machine readable instructions that when executed by the processor cause the processor to:

shift, based on actuation of the belt and the paddle, first and second sheets received at the sheet deposit position to the stopper position;

shift, based on actuation of the stopper, the first and second sheets to the eject position;

shift, based on the actuation of the belt and the paddle, the first, the second, and a third sheet received at the sheet deposit position to the stopper position;

shift, based on the actuation of the stopper, the first, second, and third sheets to the eject position; and eject, based on actuation of the ejector, a stack including the first, second, and third sheets from the eject position.

2. The printed media stack alignment apparatus according to claim 1, wherein the machine readable instructions to shift, based on the actuation of the belt and the paddle, the first and second sheets received at the sheet deposit position to the stopper position further comprise machine readable instructions to cause the processor to:

rotate the belt in a first direction to shift the first sheet that is deposited onto the belt to the stopper position; and rotate the paddle in a second direction that is generally opposite to the first direction to shift the second sheet that is deposited onto the first sheet to the stopper position, wherein the rotation of the belt is synchronized with the rotation of the paddle to simultaneously shift the first and second sheets to the stopper position.

3. The printed media stack alignment apparatus according to claim 1, wherein the machine readable instructions to shift, based on the actuation of the belt and the paddle, the first and second sheets received at the sheet deposit position to the stopper position further comprise machine readable instructions to cause the processor to:

rotate the belt in a first direction to shift the first sheet that is deposited onto the belt to the stopper position; and rotate the paddle in a second direction that is generally opposite to the first direction to shift the second sheet that is deposited onto the first sheet to the stopper position, wherein the rotation of the belt is synchronized with the rotation of the paddle to shift the second sheet to the stopper position prior to shifting of the first sheet to the stopper position.

4. The printed media stack alignment apparatus according to claim 1, wherein the machine readable instructions to shift, based on the actuation of the belt and the paddle, the first and second sheets received at the sheet deposit position to the stopper position further comprise machine readable instructions to cause the processor to:

determine that the first sheet is received at the sheet deposit position;

maintain the first sheet at the sheet deposit position;

determine that the second sheet is received onto the first sheet at the sheet deposit position; and shift, based on the actuation of the belt and the paddle, the first and second sheets received at the sheet deposit position to the stopper position.

5. The printed media stack alignment apparatus according to claim 1, wherein the machine readable instructions, when executed by the processor, further cause the processor to:

staple, based on actuation of a stapler, the stack including the first, second, and third sheets prior to ejection from the eject position.

6. The printed media stack alignment apparatus according to claim 1, wherein the paddle includes a central sub-paddle and two outer sub-paddles, and wherein the central sub-paddle is longer than the two outer sub-paddles.

7. The printed media stack alignment apparatus according to claim 1, wherein the paddle includes a central sub-paddle and two outer sub-paddles, and wherein an angle of the central sub-paddle along a rotational axis of the central sub-paddle is out-of-phase compared to respective angles of the two outer sub-paddles along the rotational axis of the central sub-paddle.

8. A method for printed media stack alignment comprising:

determining that first and second sheets are received at a sheet deposit position;

shifting, based on actuation of a belt and a paddle, the first and second sheets to a stopper position represented by register of the first and second sheets against a stopper;

shifting, based on actuation of the stopper, the first and second sheets to an eject position that is intermediate to the sheet deposit position and the stopper position;

shifting, based on the actuation of the belt and the paddle, the first sheet, the second sheet, and a third sheet received at the sheet deposit position to the stopper position;

shifting, based on the actuation of the stopper, the first, second, and third sheets to the eject position;

continuing alternating actuation of the belt and the paddle to shift the first sheet, the second sheet, the third sheet, and further sheets received at the sheet deposit position to the stopper position, and the stopper to shift the first sheet, the second sheet, the third sheet, and the further sheets to the eject position; and ejecting, based on actuation of an ejector, a stack including the first sheet, the second sheet, the third sheet, and the further sheets from the eject position.

9. The method according to claim 8, wherein shifting, based on the actuation of the belt and the paddle, the first and second sheets to the stopper position further comprises:

rotating the belt in a first direction to shift the first sheet that is deposited onto the belt to the stopper position; and rotating the paddle in a second direction that is generally opposite to the first direction to shift the second sheet that is deposited onto the first sheet to the stopper position, wherein the rotation of the belt is synchronized with the rotation of the paddle to simultaneously shift the first and second sheets to the stopper position.

10. The method according to claim 8, wherein shifting, based on the actuation of the belt and the paddle, the first and second sheets to the stopper position further comprises:

rotating the belt in a first direction to shift the first sheet that is deposited onto the belt to the stopper position; and rotating the paddle in a second direction that is generally opposite to the first direction to shift the second sheet that is deposited onto the first sheet to the stopper position, wherein the rotation of the belt is synchronized with the rotation of the paddle to shift the second sheet to the stopper position prior to shifting of the first sheet to the stopper position.

11. The method according to claim 8, wherein determining that the first and second sheets are received at the sheet deposit position and shifting, based on the actuation of the belt and the paddle, the first and second sheets to the stopper position further comprises:

determining that the first sheet is received at the sheet deposit position;

maintaining the first sheet at the sheet deposit position;

determining that the second sheet is received onto the first sheet at the sheet deposit position; and shifting, based on the actuation of the belt and the paddle, the first and second sheets received at the sheet deposit position to the stopper position.

12. A non-transitory computer readable medium having stored thereon machine readable instructions to provide printed media stack alignment, the machine readable instructions, when executed, cause a processor to:

determine that first and second sheets are received at a sheet deposit position;

actuate a belt and a paddle to shift the first and second sheets to a stopper position represented by register of the first and second sheets against a stopper;

actuate the stopper to shift the first and second sheets to an eject position or another position, wherein the eject position and the other position are intermediate to the sheet deposit position and the stopper position;

actuate the belt and the paddle to shift the first sheet, the second sheet, and a third sheet received at the sheet deposit position to the stopper position;

actuate the stopper to shift the first, second, and third sheets to the eject position or the other position; and actuate an ejector to eject a stack including the first, second, and third sheets from the eject position or the other position.

13. The non-transitory computer readable medium of claim 12, wherein the machine readable instructions to actuate the belt and the paddle to shift the first and second sheets to the stopper position, when executed, further cause the processor to:

rotate the belt in a first direction to shift the first sheet that is deposited onto the belt to the stopper position; and rotate the paddle in a second direction that is generally opposite to the first direction to shift the second sheet that is deposited onto the first sheet to the stopper position, wherein the rotation of the belt is synchronized with the rotation of the paddle to simultaneously shift the first and second sheets to the stopper position.

14. The non-transitory computer readable medium of claim 12, wherein the machine readable instructions to actuate the belt and the paddle to shift the first and second sheets to the stopper position, when executed, further cause the processor to:

rotate the belt in a first direction to shift the first sheet that is deposited onto the belt to the stopper position; and rotate the paddle in a second direction that is generally opposite to the first direction to shift the second sheet that is deposited onto the first sheet to the stopper position, wherein the rotation of the belt is synchronized with the rotation of the paddle to shift the second sheet to the stopper position prior to shifting of the first sheet to the stopper position.

15. The non-transitory computer readable medium of claim 12, wherein the machine readable instructions to determine that the first and second sheets are received at the sheet deposit position and actuate the belt and the paddle to shift the first and second sheets to the stopper position, when executed, further cause the processor to:

determine that the first sheet is received at the sheet deposit position;

maintain the first sheet at the sheet deposit position;

determine that the second sheet is received onto the first sheet at the sheet deposit position; and actuate the belt and the paddle to shift the first and second sheets received at the sheet deposit position to the stopper position.

* * * * *